US012448168B2

(12) United States Patent
Herlin et al.

(10) Patent No.: US 12,448,168 B2
(45) Date of Patent: Oct. 21, 2025

(54) CONTAINER WITH REINFORCEMENT FEATURES, RELATED SYSTEMS AND METHODS

(71) Applicant: Graphic Packaging International, LLC, Atlanta, GA (US)

(72) Inventors: Henrik Herlin, Kristianstad (SE); Filippa Melin, Malmoe (SE); Anna Naukkarinen, Helsingborg (SE)

(73) Assignee: Graphic Packaging International, LLC, Atlanta, GA (US)

( * ) Notice: Subject to any disclaimer, the term of this patent is extended or adjusted under 35 U.S.C. 154(b) by 14 days.

(21) Appl. No.: 18/515,417

(22) Filed: Nov. 21, 2023

(65) Prior Publication Data

US 2024/0166403 A1 May 23, 2024

Related U.S. Application Data

(60) Provisional application No. 63/427,237, filed on Nov. 22, 2022.

(51) Int. Cl.

| | |
|---|---|
| ***B65D 1/46*** | (2006.01) |
| ***B65D 43/08*** | (2006.01) |
| *B65D 5/26* | (2006.01) |
| *B65D 5/32* | (2006.01) |
| *B65D 5/44* | (2006.01) |

(52) U.S. Cl.

CPC ..... *B65D 1/46* (2013.01); *B65D 43/08* (2013.01); *B65D 5/26* (2013.01); *B65D 5/321* (2013.01); *B65D 5/441* (2013.01); *B65D 2543/00759* (2013.01)

(58) Field of Classification Search

CPC .... B65D 43/0204; B65D 43/02; B65D 43/08; B65D 1/46; B65D 1/42; B65D 5/441; B65D 5/44; B65D 5/26; B65D 5/20; B65D 5/321; B65D 5/32

USPC ..... 220/782, 780, 658, 657, 656; 229/123.1, 229/117.07, 117.01

See application file for complete search history.

(56) References Cited

U.S. PATENT DOCUMENTS

| | | | |
|---|---|---|---|
| 1,064,787 | A | 6/1913 | Taylor |
| 2,314,338 | A | 3/1943 | Graves et al. |
| 2,898,025 | A | 8/1959 | Walker |
| 3,655,111 | A | 4/1972 | Surerus |
| 3,696,987 | A | 10/1972 | Schuff |

(Continued)

FOREIGN PATENT DOCUMENTS

| | | | |
|---|---|---|---|
| AU | 2020256374 | A1 | 4/2021 |
| CN | 111315663 | B | 6/2020 |

(Continued)

*Primary Examiner* — Robert J Hicks

(74) *Attorney, Agent, or Firm* — Andrew N. Claerbout; FisherBroyles, LLC

(57) ABSTRACT

A container for holding at least one article includes a body having a front wall, a back wall, and at least one side wall extending at least partially around an interior of the container, a lid repositionable between a closed position at least partially overlying the body and an open position at least partially raised away from the body, the lid comprising a lid panel and a lid flange extending upwardly from the lid panel to at least partially form a lid recess, a reinforcement member at least partially received in the lid recess, and a closed bottom comprising a bottom panel attached to a portion of the body.

37 Claims, 11 Drawing Sheets

(56) References Cited

U.S. PATENT DOCUMENTS

| | | | | |
|---|---|---|---|---|
| 4,556,152 | A | 12/1985 | Bogren | |
| 5,511,680 | A | 4/1996 | Kinne | |
| 5,566,529 | A | 10/1996 | Sireix | |
| 5,752,646 | A | 5/1998 | Sandstrom | |
| 5,897,019 | A | 4/1999 | Stropkay | |
| 5,964,372 | A * | 10/1999 | Dubois | B65D 50/045 220/656 |
| 6,047,878 | A | 4/2000 | Lowry | |
| 6,644,541 | B2 | 11/2003 | Stewart et al. | |
| 7,658,318 | B2 | 2/2010 | Walsh et al. | |
| 8,061,585 | B2 | 11/2011 | Nikolai | |
| 9,169,037 | B2 | 10/2015 | Pinkstone | |
| 9,463,896 | B2 | 10/2016 | Fitzwater | |
| D896,076 | S | 9/2020 | Larsson et al. | |
| D980,055 | S | 3/2023 | Konstenius | |
| D980,056 | S | 3/2023 | Naukkarinen | |
| 11,673,718 | B2 | 6/2023 | Creighton et al. | |
| 11,878,840 | B2 | 1/2024 | Andersson | |
| 12,006,098 | B2 | 6/2024 | Sunning | |
| 12,122,571 | B2 | 10/2024 | Holka et al. | |
| 12,202,659 | B2 | 1/2025 | Holka | |
| 2003/0183540 | A1 | 10/2003 | Onishi | |
| 2005/0223680 | A1 | 10/2005 | Sireix | |
| 2006/0283927 | A1 | 12/2006 | Walsh et al. | |
| 2007/0145001 | A1 | 6/2007 | Tilton | |
| 2007/0170236 | A1 | 7/2007 | Rasanen et al. | |
| 2008/0156808 | A1 | 7/2008 | Perry et al. | |
| 2010/0282828 | A1 | 11/2010 | Burke | |
| 2011/0049229 | A1 | 3/2011 | Gillespie et al. | |
| 2011/0240666 | A1 | 10/2011 | Mihaylov | |
| 2014/0263384 | A1 * | 9/2014 | Irsch | B65D 43/022 220/780 |
| 2015/0148208 | A1 | 5/2015 | Sireix | |
| 2019/0127107 | A1 | 5/2019 | Herlin et al. | |
| 2023/0174267 | A1 | 6/2023 | Whatling et al. | |
| 2024/0166403 | A1 | 5/2024 | Herlin et al. | |
| 2024/0239567 | A1 | 7/2024 | Naukkarinen et al. | |
| 2024/0246719 | A1 | 7/2024 | Holka | |
| 2024/0262566 | A1 | 8/2024 | Holka et al. | |
| 2024/0391640 | A1 | 11/2024 | Lagerwall | |
| 2025/0033830 | A1 | 1/2025 | Naukkarinen et al. | |
| 2025/0058928 | A1 | 2/2025 | Cooke et al. | |

FOREIGN PATENT DOCUMENTS

| | | | |
|---|---|---|---|
| CN | 114728724 | A | 7/2022 |
| EP | 2 004 501 | B1 | 12/2008 |
| FR | 828311 | A | 5/1938 |
| FR | 3043069 | A1 | 5/2017 |
| JP | 02-016716 | U | 2/1990 |
| JP | 2021-084652 | A | 6/2021 |
| SE | 1951440 | A1 | 6/2021 |
| TW | 2019 36452 | | 9/2019 |
| WO | WO 2006/133394 | A2 | 12/2006 |
| WO | WO 2018/013780 | A1 | 1/2018 |
| WO | WO 2021/010889 | A1 | 1/2021 |
| WO | WO 2024/030590 | A1 | 2/2024 |
| WO | WO 2024/083308 | A1 | 4/2024 |
| WO | WO 2024/112716 | A1 | 5/2024 |
| WO | WO 2024/158671 | A1 | 8/2024 |
| WO | WO 2024/163706 | A1 | 8/2024 |
| WO | WO 2024/167993 | A1 | 8/2024 |
| WO | WO 2024/243176 | A1 | 11/2024 |
| WO | WO 2025/024749 | A1 | 1/2025 |

* cited by examiner

CONTAINER WITH REINFORCEMENT FEATURES, RELATED SYSTEMS AND METHODS

CROSS-REFERENCE TO RELATED APPLICATION

The present application claims the benefit of U.S. Provisional Patent Application No. 63/427,237, filed on Nov. 22, 2022.

INCORPORATION BY REFERENCE

The disclosure of U.S. Provisional Patent Application No. 63/427,237, filed on Nov. 22, 2022, is hereby incorporated by reference for all purposes as if set forth in its entirety.

BACKGROUND

The present disclosure generally relates to containers for holding one or more articles. In some embodiments, the present disclosure relates to containers having reinforcement features associated with one or more end portions thereof.

SUMMARY

According to one aspect, the disclosure is generally directed to a container for holding at least one article, the container comprising a body comprising a front wall, a back wall, and at least one side wall extending at least partially around an interior of the container, a lid repositionable between a closed position at least partially overlying the body and an open position at least partially raised away from the body, the lid comprising a lid panel and a lid flange extending upwardly from the lid panel to at least partially form a lid recess, a reinforcement member at least partially received in the lid recess, and a closed bottom comprising a bottom panel attached to a portion of the body.

According to another aspect, the disclosure is generally directed to a combination of blanks for forming a container for holding at least one article, the combination of blanks comprising a body blank comprising a body forming portion for at least partially forming a body with a front wall, a back wall, and at least one side wall extending at least partially around an interior of the container formed from the combination of blanks, a lid blank for at least partially forming a lid repositionable between a closed position at least partially overlying the body formed from the combination of blanks when the container is formed from the combination of blanks and an open position at least partially raised away from the body formed from the combination of blanks when the container is formed from the combination of blanks, the lid blank comprising a central portion and a marginal portion for at least partially forming a lid panel and a lid flange extending upwardly from the lid panel to at least partially form a lid recess when the container is formed from the combination of blanks, a reinforcement blank for forming a reinforcement member for being at least partially received in the lid recess when the container is formed from the combination of blanks, and a bottom blank for forming a bottom panel for being attached to a portion of the body formed from the body blank when the container is formed from the combination of blanks.

According to another aspect, the disclosure is generally directed to a method of forming a container for holding at least one article, the method comprising obtaining a body blank comprising a body forming portion, obtaining a lid blank comprising a central portion and a marginal portion, obtaining a reinforcement blank, obtaining a bottom blank, positioning the body forming portion of the body blank to form a body extending at least partially around an interior of the container, positioning the bottom blank to form a bottom panel and attaching the bottom panel to the body to form a bottom a closed bottom of the container, positioning the central portion of the lid blank to form a lid panel and positioning the marginal portion of the lid blank to form a lid flange extending upwardly form the lid panel to form a lid of the container such that a lid recess is at least partially formed between the lid panel and the lid flange, and such that the lid repositionable between a closed position at least partially overlying the body and an open position at least partially raised away from the body, and positioning the reinforcement blank in the lid recess to form a reinforcement member of the container.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

Containers according to the present disclosure can accommodate articles of numerous different shapes. For the purpose of illustration and not for the purpose of limiting the scope of the disclosure, the following detailed description describes articles such as food products. Such food products can be provided in discrete or granular portions, e.g., as in snacks, for example, candy, gum, chocolate, granola, cereal, nuts, trail mix, raisins, dried fruit, etc. It will be understood that a different type of article such as a different type of food product or different type of article, e.g., powdered food products or powdered articles, can be held in containers according to the present disclosure without departing from the disclosure. It will be further understood that articles other than food products can be held in containers according to the present disclosure.

In this specification, the terms "lower," "bottom," "upper," and "top" indicate orientations determined in relation to fully erected and upright containers. As described herein, containers can be formed from blanks by overlapping multiple panels, portions, and/or end flaps. Such panels, portions and/or end flaps may be designated herein in terms relative to one another, e.g., "first", "second", "third", etc., in sequential or non-sequential reference, without departing from the disclosure.

FIGS. 1-5 are plan views of a series of blanks used to form components that assemble to form a container 105 (FIG. 7) according to an exemplary embodiment of the present disclosure. In this regard, in some embodiment the container 105 can be considered an assembly or system of a plurality of components.

Figure 1:
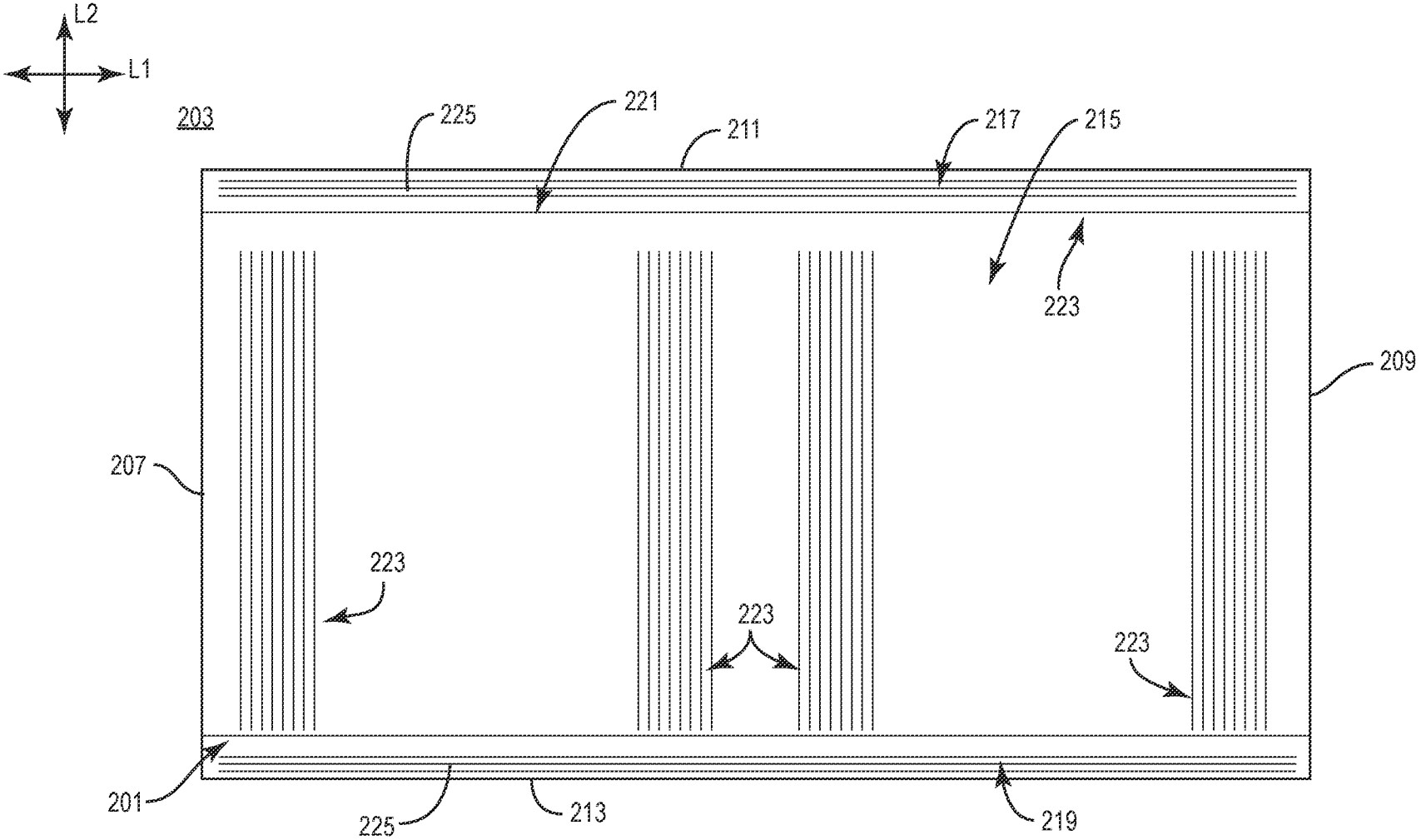
FIG. 1 is a plan view of an exterior surface of a body blank used to form a body of a container according to an exemplary embodiment of the disclosure.

Referring to FIG. 1, a plan view of an exterior surface 201 of a body blank 203 for forming a body 205 of the container 105 is illustrated. As described herein, the body 205 is arranged to extend at least partially around an interior 107 of the container 105.

As shown, the body blank 203 can have a longitudinal axis L1 and a lateral axis L2. In some embodiments, the axes L1, L2 can be transposed. In the illustrated embodiment, the body blank 203 can have a generally rectangular configuration with a pair of opposite lateral free edges 207, 209 and a pair of opposite longitudinal free edges 211, 213 extending from a respective endpoint of the free edge 207 to a respective endpoint of the free edge 209.

The body blank 203 can also include a body forming portion 215 defined along a central portion of the body blank 203, a first or top end or lid forming portion 217 defined at an upper peripheral portion/upper marginal portion of the body blank 203, and a second or bottom end forming portion 219 defined at a lower peripheral portion/lower marginal portion of the body blank 203.

As shown, the lid forming portion 217 of the body blank 203 can be at least partially separably connected to the body forming portion 215 and at least partially foldably connected to the body forming portion 215 at a longitudinal line of weakening 221 that can include at least one tear segment and at least one fold line segment.

With continued reference to FIG. 1, the body blank 203 can include a multiple pluralities of lateral lines of weakening 223 that can facilitate the formation of curved corners when the body 205 is formed from the body blank 203, as described further herein.

The body blank 203 can also include one or more pluralities of longitudinal lines of weakening 225 extending therealong. In the illustrated embodiment, the body blank 203 can include a plurality of longitudinal lines of weakening 225 extending across the lid forming portion 217 and another plurality of longitudinal lines of weakening 225 extending along the body forming portion 219. As described further herein, the lines of weakening 225 can facilitate formation of the body 205 from the body blank 203.

In some embodiments, the body blank 203 can be comprised of one or more paperboard materials made predominantly from cellulose fibers or paper fibers. The material may be provided in the form of a continuous web or may be provided as individual sheets of material. The paperboard material may be a single ply or multi ply material and may be a laminate comprising one or more reinforcing, moisture resistant non-cellulosic layers of materials such as films and coatings, metal foil, etc. The paperboard material may be coated, printed, embossed, etc. and may comprise fillers, pigments, binders and other additives as known in the art. In some embodiments, the paperboard material can be devoid of polymeric and/or metallic materials.

Figure 2:
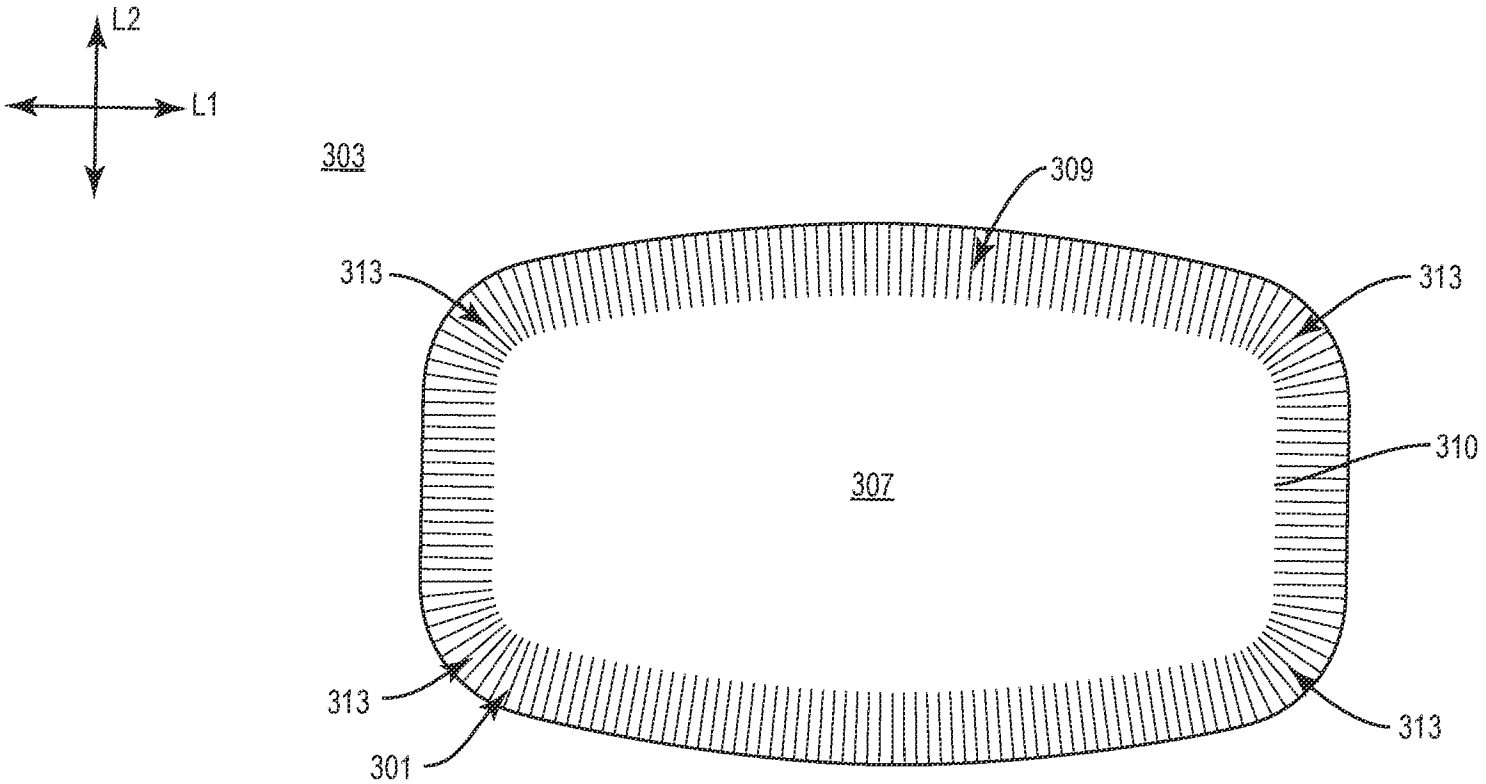
FIG. 2 is a plan view of an exterior surface of a lid blank for forming a lid or top end of a container according to an exemplary embodiment of the disclosure.

Turning to FIG. 2, the exterior surface 301 of a lid blank 303 for at least partially forming a lid 109 of the container 105 is illustrated. As shown, the lid blank 303 can have the longitudinal axis L1 and the lateral axis L2, and can include a central portion 307 and a marginal portion 309 extending to the peripheral edges of the lid blank 303.

In some embodiments, the marginal portion 309 of the lid blank 303 can be at least partially foldably connected to the central portion 307 at a generally rounded rectangular/elliptical fold line 310. In other embodiments, one or more foldable connections between the marginal portion 309 of the lid blank 303 and the central portion 307 of the lid blank 303 can be formed upon formation of the lid 109 of the container 105, as described further herein.

As also shown, the lid blank 303 can include multiple pluralities of oblique and/or curved lines of weakening 313 arranged along corner portions of the lid blank 303. As described further herein, the lines of weakening 313 can facilitate formation of the lid 109/container 105.

It will be understood that the lid blank 303 can be formed from one or more materials that are the same or similar to those that form the body blank 203 as described above, e.g., paperboard materials.

Figure 3:
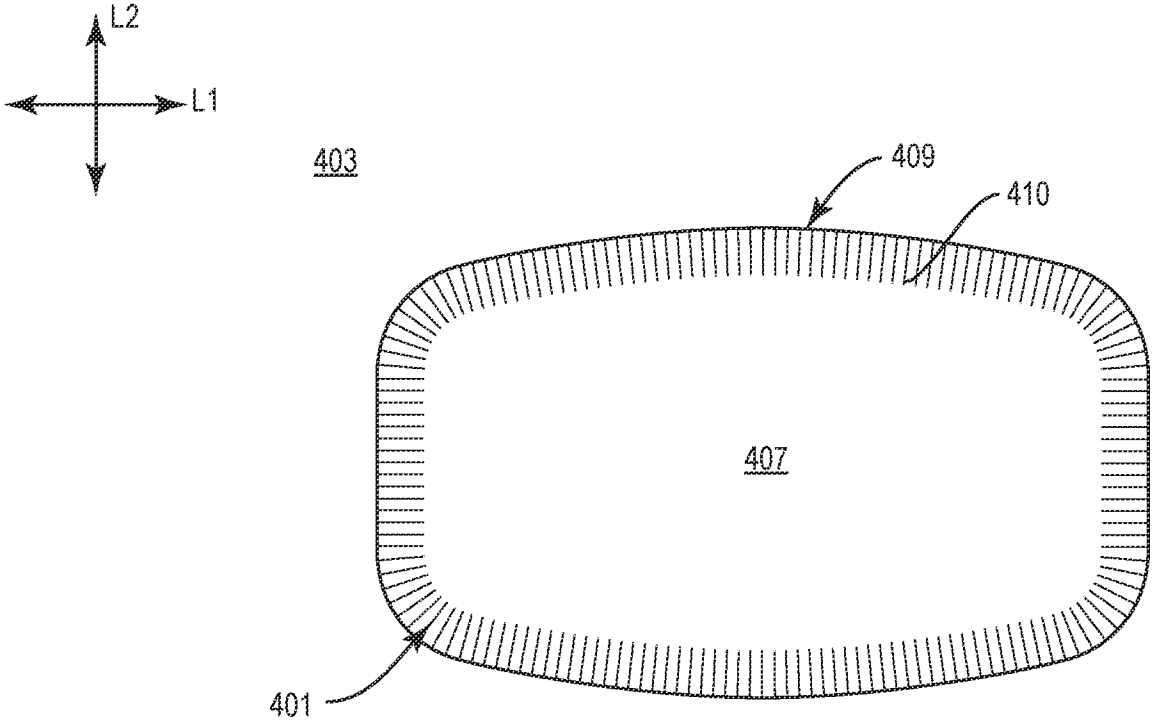
FIG. 3 is a plan view of an exterior surface of a bottom blank for forming a bottom of a container according to an exemplary embodiment of the disclosure.

Turning to FIG. 3, the exterior surface 401 of a bottom blank 403 for at least partially forming a closed bottom or closed end 111 of the container 105 is illustrated.

As shown, the bottom blank 403 can have a configuration generally similar to that of the lid blank 303 described above, e.g., having the longitudinal axis L1 and the lateral axis L2, a central portion 407, and a marginal portion 409 extending to the peripheral edges of the bottom blank 403. In the illustrated embodiment, the marginal portion 409 can be at least partially foldably connected to the central portion 407 at a generally rounded rectangular/elliptical fold line 410, though the blank 403 can be devoid of the fold line 410 without departing from the disclosure.

Figure 4:
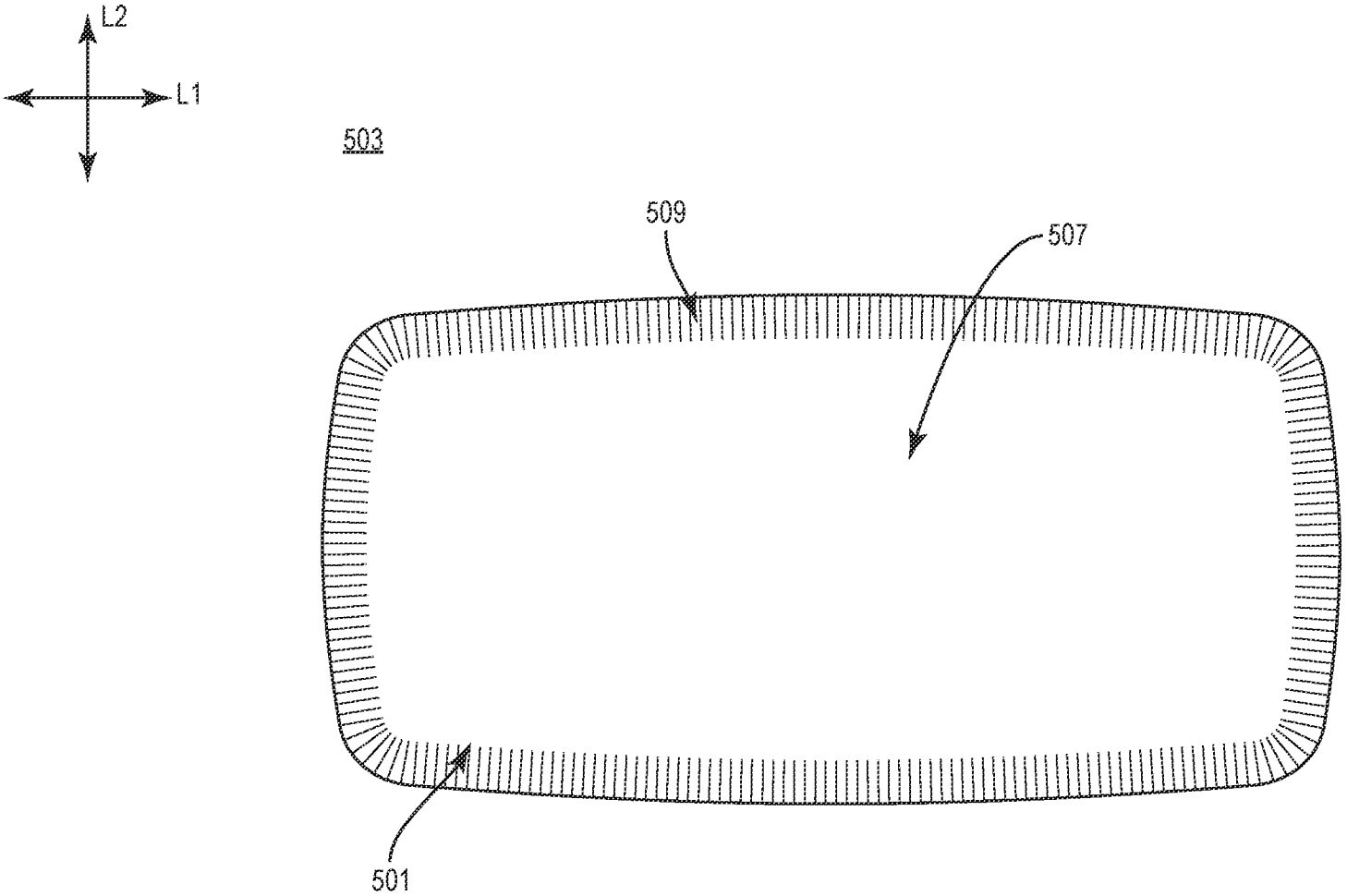
FIG. 4 is a plan view of an exterior surface of a reinforcement blank for forming a reinforcement member of a container according to an exemplary embodiment of the disclosure.

Referring to FIG. 4, the exterior surface 501 of a reinforcement blank 503 for forming one or more reinforcement members 505 of the container 105 is illustrated.

As shown, the reinforcement blank 503 can have the longitudinal axis L1 and the lateral axis L2. The blank can include a central portion 507 and a marginal portion 509 extending to the peripheral edges of the reinforcement blank 503. In some embodiments, the marginal portion 509 of the reinforcement blank 503 can be at least partially foldably connected to the central portion 507 at one or more lines of weakening, e.g., fold lines. In other embodiments, one or more foldable connections between the marginal portion 509 of the lid blank 503 and the central portion 507 of the blank 503 can be formed upon formation of the reinforcement member(s) 505.

As also shown, the reinforcement blank 503 can include multiple pluralities of oblique and/or curved lines of weakening arranged along the marginal portion 509 thereof, though the blank 503 and reinforcement member 505 formed therefrom could be devoid of such features without departing from the disclosure.

The reinforcement blank 503 can be formed of a pulp fiber material. In the illustrated embodiment, the reinforcement blank 503 and reinforcement member(s) 505 formed therefrom can be free from plastic materials. In some embodiments, the reinforcement blank 503/reinforcement member 505 can be formed of a material that includes from about 95% to about 100% of pulp fibers, such as softwood pulp fibers, optionally virgin softwood pulp fibers. In some embodiments, the reinforcement blank 503/reinforcement member 505 can be formed of a material that includes about 98% to about 100% of pulp fibers. Examples of such pulp fiber materials which have been developed for molding applications such as molded trays and blisters, shaped or embossed boxes, etc. are produced e.g. at Billerud Gruvön of Gums, Sweden and sold as Billerud FibreForm® contact formable paper. A similar formable paper material is sold as Advantage Formable by Mondi of Surrey, United Kingdom.

Figure 5:
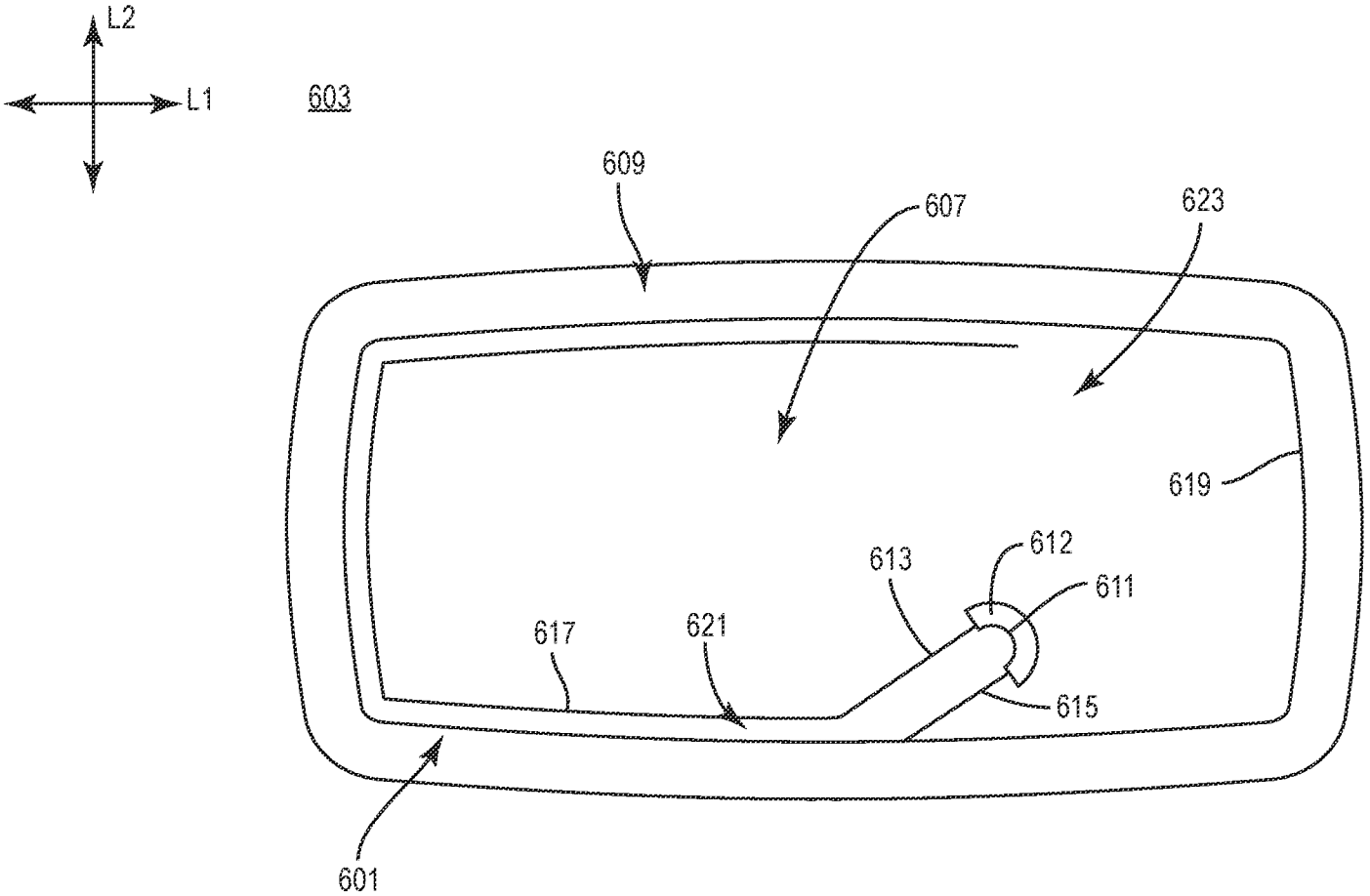
FIG. 5 is a plan view of an exterior surface of a barrier blank for forming a barrier member of a container according to an exemplary embodiment of the disclosure.

Turning to FIG. 5, the exterior surface 601 of a barrier blank 603 for forming a barrier member 605 of the construct 105 is illustrated.

The barrier blank 603 can have the longitudinal axis L1 and the lateral axis L2, and can include a central portion 607 and a marginal portion 609 extending to the peripheral edges of the barrier blank 603. In some embodiments, the marginal portion 609 of the barrier blank 603 can be at least partially foldably connected to the central portion 607 at one or more lines of weakening, e.g., fold lines. In other embodiments, one or more foldable connections between the marginal portion 609 of the blank 603 and the central portion 607 of the blank 603 can be formed upon formation of the barrier member 605.

In the illustrated embodiment, the barrier blank 603 and barrier member 605 formed therefrom can include a tear feature that includes a pull tab 611 at least partially extending into an access opening 612, the pull tab 611 at least partially defined by a pair of oblique and spaced lines of weakening 613, 615. An endpoint of the line of weakening 613 can intersect a generally rounded C-shaped line of weakening 617 positioned in the central portion 607 of the barrier blank 603. As also shown, an endpoint of the line of weakening 615 can intersect a generally rounded rectangular line of weakening 619 positioned in the central portion 607 of the barrier blank 603.

Accordingly, portions of the central portion 607 between the lines of weakening 613, 615 and between the lines of weakening 617, 619 can be peripheral tear regions 621 of the barrier blank 603 and barrier member 605 formed therefrom, and portions of the central portion 607 between bounded by the line of weakening 619 can be a central tear region 623 of the barrier blank 603 and barrier member 605 formed therefrom.

In this regard, one or more of the pull tab 611, access opening 612, lines of weakening 613, 615, 617, 619, and tear regions 621, 623 can be access features or tear features of the barrier blank 603 and barrier member 605 formed therefrom, and further, the container 105 formed therefrom for facilitating access to articles A (FIG. 6B) in the interior 107 of the container 105.

In some embodiments, the barrier blank 603 and barrier member 605 formed therefrom can be formed from one or more materials that can include aluminum foil, silicon-coated paper, plastic film, or laminates thereof. For example, in the illustrated embodiment, the barrier blank 603 can include at least a layer of paperboard material laminated with a layer of foil. In some embodiments, the barrier blank 603 and barrier member 605 formed therefrom can be formed of a paperboard material that is devoid of polymeric and/or metallic materials.

One or more of the blanks 203, 303, 403, 503, 603 and one or more of the associated features thereof can have a different arrangement and/or configuration without departing from the disclosure. For example, and as described further herein, the body blank 203 can be formed into a body 205 of the container 105 with a generally rounded rectangular or elliptical vertical cross-section, with each of the blanks 303, 403, 503, 603 having a corresponding cross-section for being at least partially received in the interior 107 of the container 105/body 205. In some embodiments, the body 205 can be formed with a different vertical cross-sectional configuration, and the blanks 303, 403, 503, 603 can have a different configuration corresponding to such vertical cross-sectional configuration.

As described herein, the blanks 203, 303, 403, 503, 603 can be further formed to provide components that assemble to form the container 105. In this regard, the blanks 203, 303, 403, 503, 603 can be provided in combination for forming a system in the form of the container 105. In some embodiments, such a combination can exclude the barrier blank 603, for example, in embodiments in which it is desired to form and provide a container that is devoid of a barrier member such as that formed from the barrier blank 603.

Figure 6A:
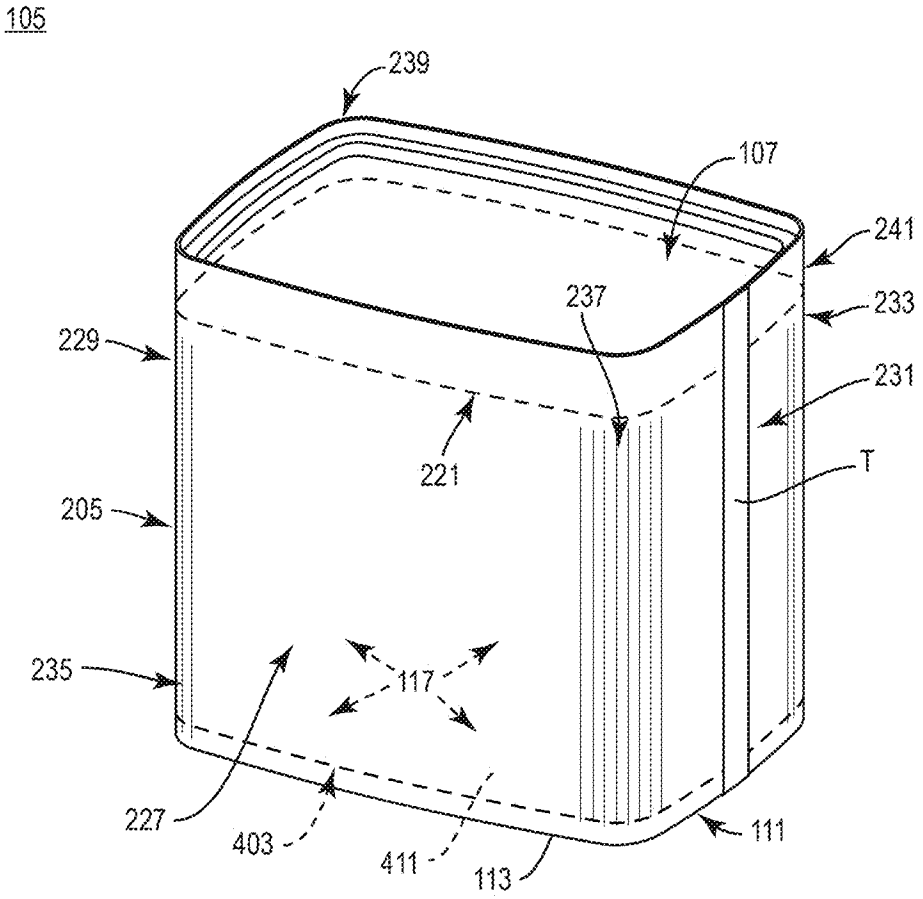
FIGS. 6A-6C are sequential perspective views of a formation of a container from the blanks of FIGS. 1-5 according to an exemplary embodiment of the disclosure.
Figure 6B:
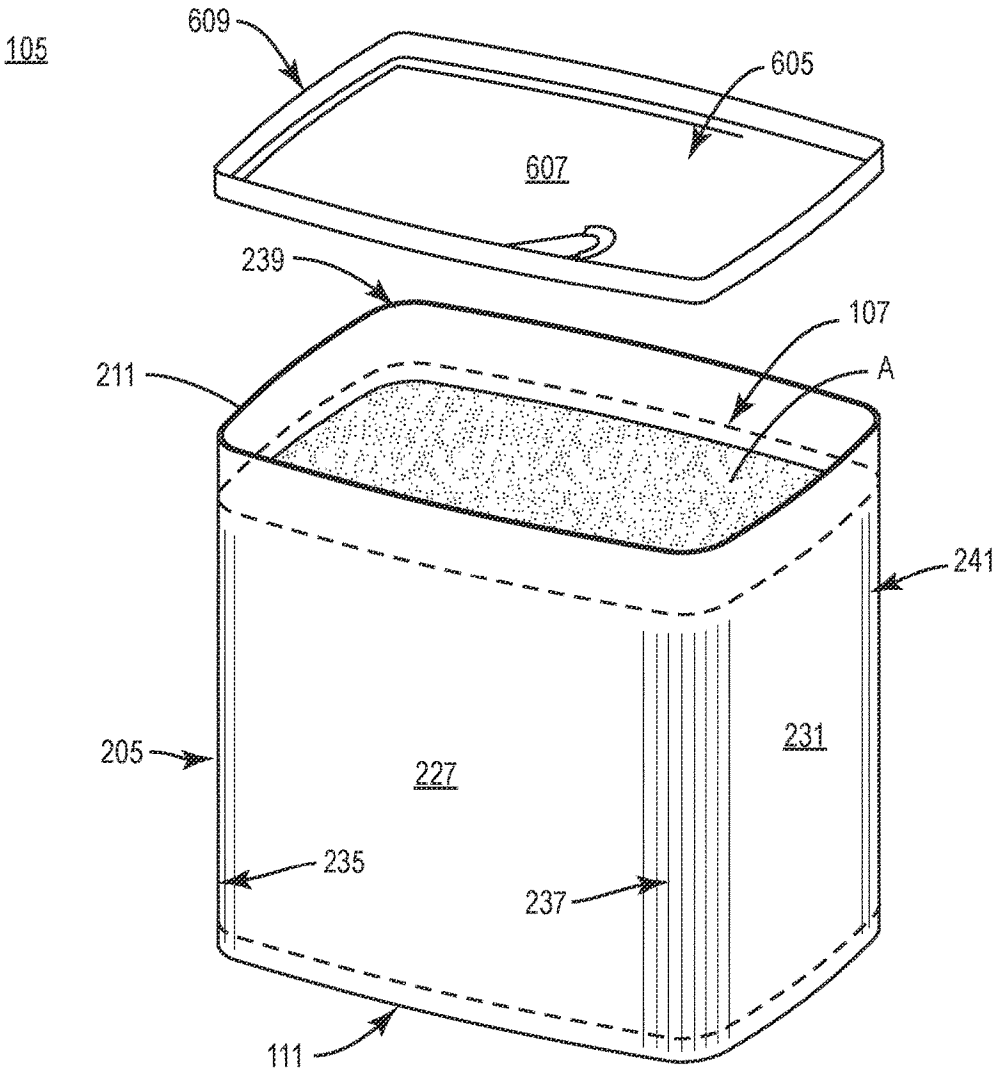
Figure 6C:
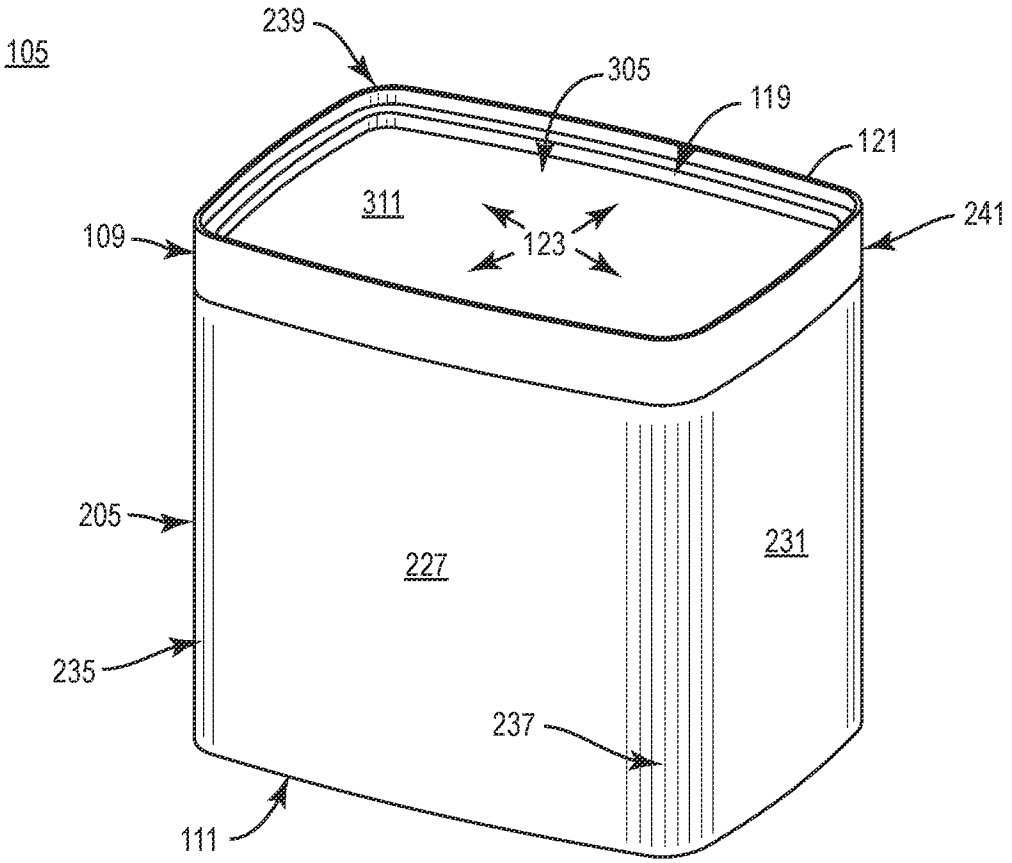

Turning to FIGS. 6A-6C, formation of the container 105 from the blanks 203, 303, 403, 503, 603 will be described according to an exemplary embodiment of the disclosure.

The body blank 203 can be positioned to extend at least partially around an interior 107 of the container 105. In one embodiment, the body blank 203 can be at least partially bent, curved, folded, etc., for example, at the fold lines 223, into a generally elliptical or rounded rectangular cross-section, with portions of the body blank 203 proximate the free edges 207, 209 at least partially overlapped to form a seam arrangement, which can be maintained with a strip of adhesive tape T. In some embodiments, the free edges 207, 209 of the blank 203 can be brought into generally edge-to-edge contact.

The overlapping/meeting portions of the body blank 203 can be joined, for example, with an adhesive such as glue, with an adhesive coated tape or substrate, and/or through another method of joining such as ultrasonic welding, RF welding, interfering locking arrangements, etc.

As shown, the body 205 of the container 105 can thus be formed, with respective portions of the body forming portion 215 of the blank 203 forming a front wall or front panel 227, a first side wall or first side panel 229, a second side wall or second side panel 231, and a back wall or back panel 233. Respective curved corners 235, 237, 239, 241 can be formed between the respective panels 227, 229, the respective panels 227, 231, the respective panels 229, 233, and the respective panels 231, 233. In some embodiments, the blank 203 can be provided with one or more lines of weakening for facilitating such formation of rounded or curved corners of the body 205.

As described above, in some embodiments, the body 205 of the container 105 can be formed into a different cross-sectional configuration, e.g., circular, elliptical, triangular, rectangular, square, pentagonal, hexagonal, heptagonal, octagonal, etc., including rounded or curved corner variations thereof.

With continued reference to FIGS. 6A-6C, the closed bottom 111 of the container 105 can be formed, according to the illustrated embodiment, by positioning the bottom blank 403 in the interior 107 of the container 105, with the central portion 407 of the bottom blank 403 positioned in generally perpendicular relation with the panels 227, 229, 231, 233 so as to form a bottom panel 411 of the container 105. As shown, the bottom blank 403 can be positioned a vertical distance above the longitudinal free edge 213 of the blank 203 in order to form a recessed bottom configuration of the container 105, as described further herein.

The marginal portion 409 of the bottom blank 403 can be bent or folded downwardly relative to the central portion 407 of the blank 403/bottom panel 411, for example, at the fold line 410, and attached, e.g., adhered with an adhesive such as glue, welded, or otherwise attached, to the interior surface of one or more of the panels 227, 229, 231, 233 and corners 235, 237, 239, 241 of the body 205 of the container 105 in the interior 107 thereof.

Simultaneously or thereafter, the bottom forming portion 219 of the blank 203 can be bent/curled or folded, for example, at the longitudinal lines of weakening 225, over the marginal portion 409 of the bottom blank 403 to form a bottom flange 113 of the container 105 that extends downwardly from the bottom panel 411. In some embodiments, the bottom forming portion 219 of the blank 203 can be crimped in such an arrangement. The bottom flange 113 can define a bottom edge of the container 105.

In this regard, a bottom recess 117 can be at least partially formed between the bottom flange 113 of the container 105 and the bottom panel 411 of the container 105. The bottom recess 117 can be positioned and arranged for at least partially receiving a reinforcement member of the container, as described further herein.

With continued reference to FIGS. 6A-6C, the container 105 having the closed bottom 111 can be positioned, e.g., with the bottom flange 113 extending downwardly, supported on a surface such as a conveyor for being positioned below a filling station within which one or more articles A can be deposited and held in the interior 107 of the container 105. In some embodiments, a container 105 can be supported in a generally stationary position and one or more filling devices can be brought into proximity with the container 105 for depositing articles A in the interior 107 of the container 105.

After filling the interior 107 of the container 105 with articles A, the barrier blank 603 can be positioned in the interior 107 of the container 105 above the articles A, with the central portion 607 of the barrier blank 603 positioned in generally perpendicular relation with the panels 227, 229, 231, 233. As shown, the barrier blank 603 can be positioned a vertical distance below the longitudinal free edge 211 of the blank 203/body 205.

The marginal portion 609 of the barrier blank 603 can be bent or folded upwardly relative to the central portion 607 of the barrier blank 603 and attached, e.g., adhered with an adhesive such as glue, welded, or otherwise attached, to the interior surface of one or more of the panels 227, 229, 231, 233 and corners 235, 237, 239, 241 of the body 205 of the container 105 in the interior 107 thereof to form the barrier member 605, with the access/tear features presented along a planar portion of the barrier member 605.

It will be understood that, in some embodiments, the container 105 can be provided without a barrier member if desired and the step of forming and positioning the barrier member 605 described above can be omitted.

Following formation and positioning of the barrier member 605 (or following filling of the container 105 if it is desired to provide the container 105 without a barrier member), the lid blank 303 can be positioned in the interior 107 of the container 105 above the barrier member 605. As shown, the lid blank 303 can be positioned a vertical distance below the top edge 121 of the container 105 order to form a recessed top configuration of the container 105, as described further herein.

The central portion 307 of the lid blank 303 can be positioned in generally perpendicular relation with the panels 227, 229, 231, 233 so as to form a lid panel 311 of the container 105.

The marginal portion 309 of the lid blank 303 can be bent or folded downwardly relative to the central portion 307 of the blank 303/lid panel 311, for example, at the fold line 310, and attached, e.g., adhered with an adhesive such as glue, welded, or otherwise attached, to the interior surface of one or more of the panels 227, 229, 231, 233 and corners 235, 237, 239, 241 of the body 205 of the container 105. It will be understood that the lines of weakening 313 can facilitate positioning of the marginal portion 309 relative to corners 235, 237, 239, 241.

Simultaneously or thereafter, the lid forming portion 217 of the blank 203 can be bent/curled or folded, for example, at the longitudinal lines of weakening 225, over the marginal portion 309 of the lid blank 303 to form a lid collar or lid flange 119 of the lid 109 of the container 105 extending upwardly from the lid panel 311. In some embodiments, the lid forming portion 217 of the blank 203 can be crimped in such an arrangement. The lid flange 119 can define a top edge 121 of the lid 109/container 105.

As shown, a lid or top recess 123 can be at least partially formed between the lid flange 119 of the container 105 and the lid panel 311 of the container 105. The lid recess 123 can be positioned and arranged for at least partially receiving a reinforcement member 505 (broadly, "first reinforcement member") of the container 105, as described further herein.

Figure 7A:
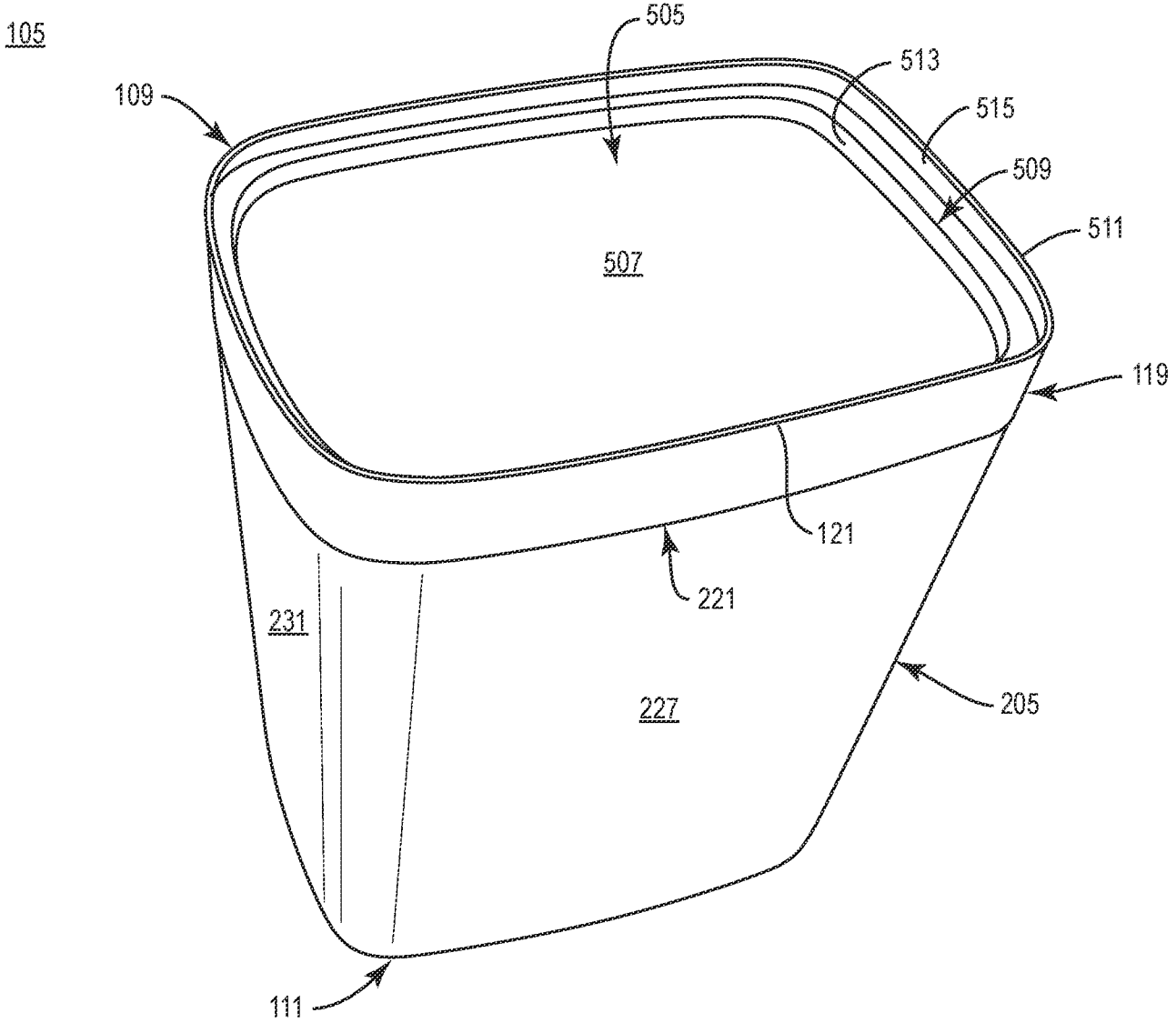
FIG. 7A is a perspective view of a container formed from the blanks of FIGS. 1-5 according to an exemplary embodiment of the disclosure with a lid thereof in a closed position.

With additional reference to FIG. 7A, the reinforcement blank 503 can be formed into a reinforcement member 505 by a suitable molding process, e.g., transfer molding or thermoformed molding (cure-in-the mold). In this regard, a reinforcement member 505 can be molded so as to have desirable structural properties, e.g., density, resistance to bending, resistance to compression, tear resistance, etc. In some embodiments, the reinforcement member 505 can be formed so as to have a density within the range of from about 0.2 $kg/dm^3$ to about 1.5 $kg/dm^3$, optionally within the range of from about 0.2 $kg/dm^3$ to about 1 $kg/dm^3$, optionally within the range of from about 0.4 $kg/dm^3$ to about 0.8 $kg/dm^3$.

In the illustrated embodiment. 8, the reinforcement blank 503 can be subject to a suitable molding process to produce a reinforcement member 505 having a generally planar central portion 507 recessed/stepped away from a generally planar intermediate flange or intermediate rim 509. The intermediate rim 509 can be recessed/stepped away from a generally planar outer flange or outer rim 511.

As shown, a first vertical wall 513 extends from the central portion 507 of the reinforcement member 505 to the intermediate rim 509, and a second vertical wall 515 extends from the intermediate rim 509 to the outer rim 511 along the lid flange 119.

It will be understood that the reinforcement blank 503 can be differently configured into the reinforcement member 505 without departing from the disclosure. For example, a different arrangement of walls and rims/flanges can be provided without departing from the disclosure. In some embodiments, one or more of the rims 509, 511 and walls 513, 515 can have an oblique, curved, arched, etc., configuration.

As described above, a reinforcement blank 503 can be provided and formed into a reinforcement member 505 and inserted into the lid recess 123 of the container 105 in order to reinforce a top end portion of the container 105.

In such an arrangement, the reinforcement member 505 can be at least partially inserted into the top recess 123 such that at least the outer surface of the outer rim 511 is positioned to contact and overlie the top edge 121 of the lid 109/container 105.

In some embodiments, the reinforcement member 505 can be suitably sized and configured so as to be press-fit into the top recess 123, e.g., such that compressive engagement of the reinforcement member 505 by the lid flange 119 and/or frictional engagement between contacting portions of the reinforcement member 505 and the lid flange 119 can maintain the position of the reinforcement member 505 in the top recess 123. In this regard, the reinforcement member 505 can be configured as a plug for at least partial received in the top recess 123.

In some embodiments, the upper rim 511 of the reinforcement member 505 can be adhered, welded, or otherwise attached to the lid flange 119 in order to couple the reinforcement member 505 to the remainder of the container 105.

In some embodiments, the central portion 507, intermediate rim 509, outer rim 511, vertical wall 513, and/or vertical wall 515 can engage respective portions of the lid 109/closed top end of the container 105. For example, the lid 109 can be configured with one or more protruding features that mate or engage the central portion 507 and/or intermediate rim 509, e.g., in a nested and/or locking arrangement.

In some embodiments, at least the central portion 507 of the reinforcement member 505 can have an at least partially curved arrangement that contours a similarly curved configuration of the lid panel 311.

Figure 7B:
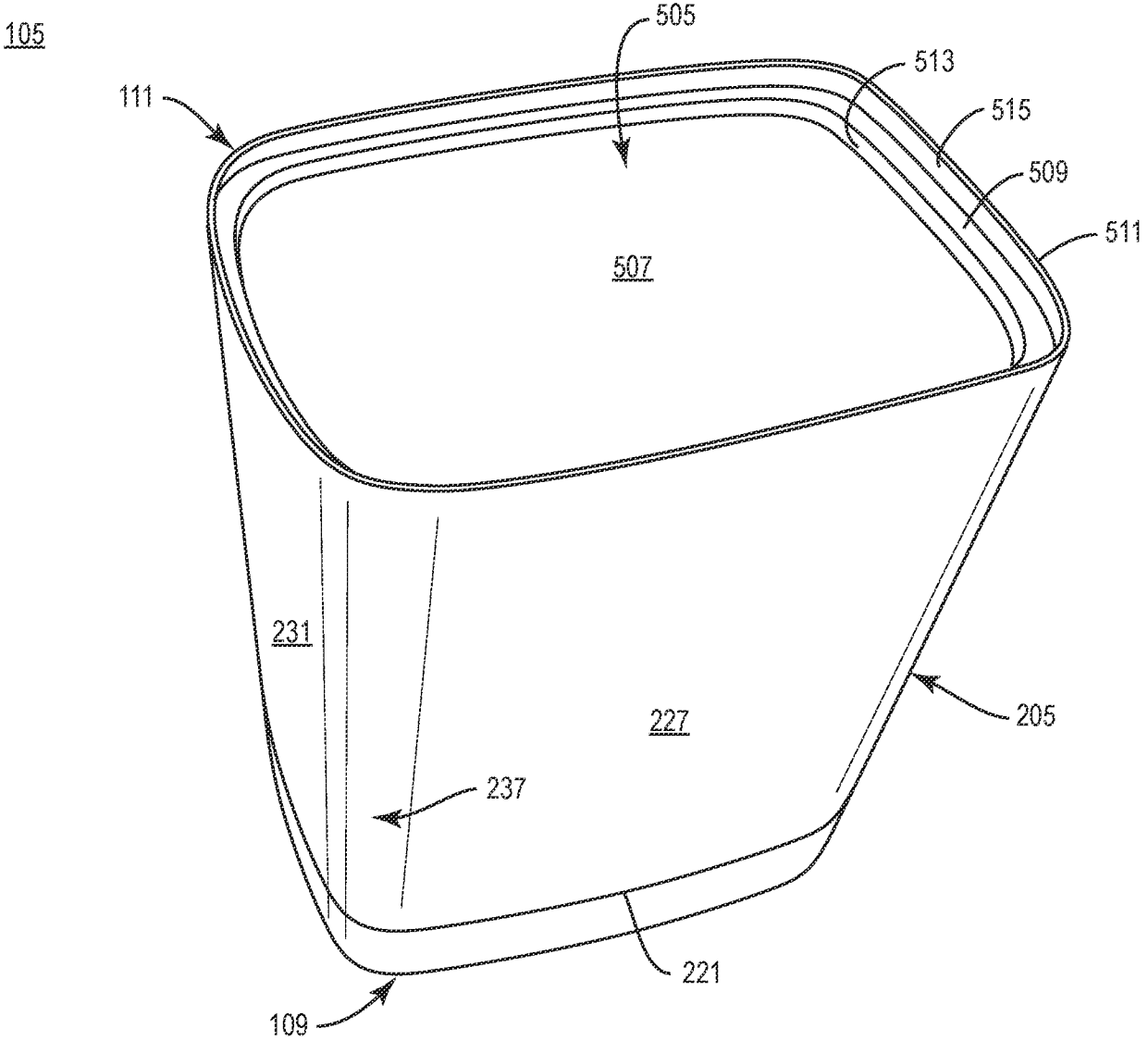
FIG. 7B is another perspective view of the container of FIG. 7A.

With additional reference to FIG. 7B, in some embodiments, a reinforcement blank 503 can be formed into a reinforcement member 505 (broadly, "second reinforcement member") and at least partially inserted into the bottom recess 117 of the container 105 in a manner consistent with that described above with regard to the positioning of the reinforcement member 505 in the top recess 123 of the container 105. For example, at least the outer surface of the outer rim 511 can be positioned to contact and overlie the bottom edge of the container 105, with one or more portions of the intermediate rim 509, outer rim 511, vertical wall 513, and/or vertical wall 515 at least partially received in the bottom recess 117 of the container 105 extending along a respective portion of the bottom flange 113.

In some embodiments, the reinforcement member 505 can be suitably sized and configured so as to be press-fit into the bottom recess 117. In some embodiments, the upper rim 511 of the reinforcement member 505 can be adhered, welded, or otherwise attached to the bottom flange 113 in order to couple the reinforcement member 505 to the remainder of the container 105. In some embodiments, the central portion 507, intermediate rim 509, outer rim 511, vertical wall 513, and/or vertical wall 515 can engage respective portions of the closed bottom 111 of the container 105, e.g., in a nested and/or locking arrangement. In some embodiments, at least the central portion 507 of the reinforcement member 505 can have an at least partially curved arrangement that contours a similarly curved configuration of the bottom panel 411.

It will be understood that, optionally, a reinforcement member 505 can be provided engaged with one of the top end/lid 109 of the container 105 and the bottom end 111 of the container 105, and not the other. Versatility in reinforcing a desired end portion of the container 105 or both end portions of the container 105 is thus afforded by a modular configuration of the components of the container 105.

Figure 8:
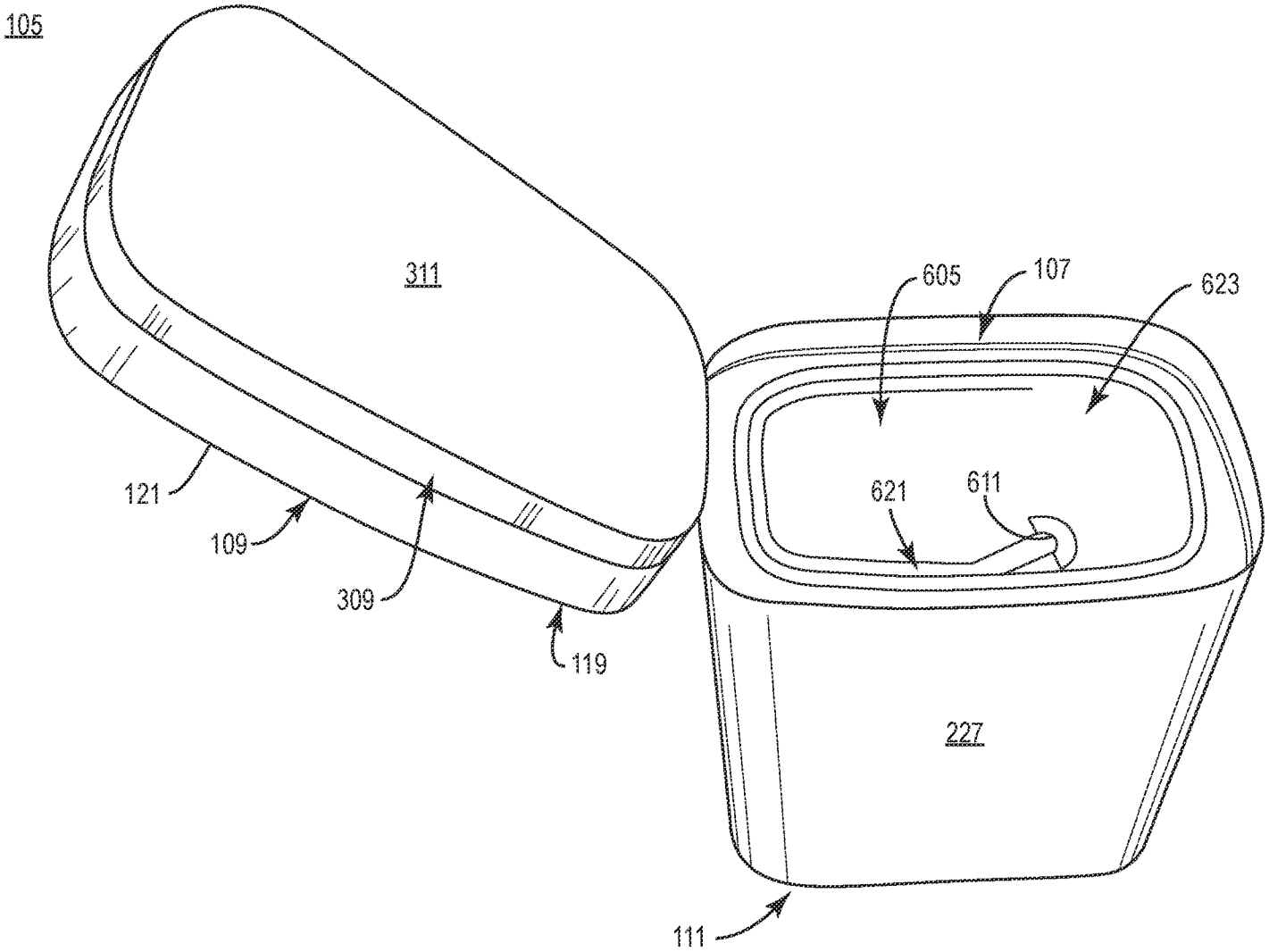
FIG. 8 is a perspective view of the container of FIG. 7A with a lid thereof in an open position according to an exemplary embodiment of the disclosure.

Turning to FIG. 8, in order to access the interior 107 of the container 105, a user can separate the lid 109 from the body 205 of the container 105 along tear line segments of the line of weakening 221 and hingably/foldably move the lid 109 about a fold line segment of the line of weakening 221 to allow the lid 109 to be arranged in an open position, in which the lid 109 is raised away from the interior 107 of the container 105, and a closed position, in which the lid 109 at least partially overlies the body 205 and/or is at least partially received in the interior 107 of the container 105.

When the lid 109 is in an open position, a user can remove the barrier member 605 (if provided), to access articles A held therebeneath. In one embodiment, a user can grasp the pull tab 611 and pull the tab 611 so as to separate the pull tab 611 from the remainder of the barrier member 605 at the lines of weakening 613, 615. The user can further pull the tab 611 to separate the tear regions 621, 623 from the remainder of the barrier member 605 at the respective lines of weakening 617, 619 to provide access to the contents of the container 105 therebelow.

In view of the foregoing, an openable and reclosable container 105 is provided with reinforcement features via the reinforcement member 505 engaged with one or both of the ends 109, 111 of the container 105. Such reinforcement of the end(s) of the container 105 can provide a robust construction that is resistant to crushing, warping, or other unwanted deformation, for example, in the course of stacking, loading, or incidental to movement or storage.

In some embodiments, the reinforcement member(s) 505 can provide resistance to bulging of one or both of the respective lid panel 311 and bottom panel 411, for example, due to heavily weighted articles or tightly packed articles provided in the interior 107 of the container 105.

In some embodiments, the reinforcement member(s) 505 can at least partially overlie and obscure textured surfaces (e.g., pleating, bunching, etc.) of the container 105 caused by the arrangement of the crimped/curled arrangements of one or both of the top flange 119 and bottom flange 113 of the container 105, e.g., proximate the respective top edge 121 and bottom edge thereof.

It will be understood that the container 105 and/or one or more components thereof can have a different configuration without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the containers to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure container panels or portions in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A container for holding at least one article, the container comprising:

a body comprising a front wall, a back wall, and at least one side wall extending at least partially around an interior of the container;

a lid repositionable between a closed position at least partially overlying the body and an open position at least partially raised away from the body, the lid comprising a lid panel and a lid flange extending upwardly from the lid panel to at least partially form a lid recess;

a reinforcement member at least partially received in the lid recess; and a closed bottom comprising a bottom panel attached to a portion of the body.

2. The container of claim 1, wherein the reinforcement member comprises pulp fibers.

3. The container of claim 2, wherein the reinforcement member comprises molded pulp fibers.

4. The container of claim 3, wherein the reinforcement member is molded so as to have a density within the range of from about 0.2 $kg/dm^3$ to about 1.5 $kg/dm^3$.

5. The container of claim 2, wherein the reinforcement member comprises a central portion and at least one wall extending upwardly from the central portion along the lid flange.

6. The container of claim 5, wherein the at least one wall of the reinforcement member comprises a first vertical wall and a second vertical wall, and the reinforcement member comprises an intermediate flange extending from the first vertical wall to the second vertical wall.

7. The container of claim 6, wherein an outer rim extends away from the second vertical wall to at least partially overlie a top edge of the lid.

8. The container of claim 5, wherein the reinforcement member is a first reinforcement member at least partially received in the lid recess, wherein a bottom recess of the container is at least partially formed between the bottom panel and a bottom flange extending away from the bottom panel, and the container further comprises a second reinforcement member at least partially received in the bottom recess.

9. The container of claim 8, wherein the second reinforcement member comprises molded pulp fibers.

10. The container of claim 9, wherein the second reinforcement member comprises a central portion and at least one wall extending downwardly from the central portion along the bottom flange.

11. The container of claim 5, wherein the lid flange is at least partially separable from and at least foldably connected to the body at a line of weakening.

12. The container of claim 11, wherein the container further comprises at least one barrier member attached to the body in the interior of the container.

13. The container of claim 12, wherein the at least one barrier member comprises a pull tab and at least one tear region at least partially separable from the remainder of the at least one barrier member to facilitate access to the interior of the container.

14. A combination of blanks for forming a container for holding at least one article, the combination of blanks comprising:

a body blank comprising a body forming portion for at least partially forming a body with a front wall, a back wall, and at least one side wall extending at least partially around an interior of the container formed from the combination of blanks;

a lid blank for at least partially forming a lid repositionable between a closed position at least partially overlying the body formed from the combination of blanks when the container is formed from the combination of blanks and an open position at least partially raised away from the body formed from the combination of blanks when the container is formed from the combination of blanks, the lid blank comprising a central portion and a marginal portion for at least partially forming a lid panel and a lid flange extending upwardly from the lid panel to at least partially form a lid recess when the container is formed from the combination of blanks;

a reinforcement blank for forming a reinforcement member for being at least partially received in the lid recess when the container is formed from the combination of blanks; and a bottom blank for forming a bottom panel for being attached to a portion of the body formed from the body blank when the container is formed from the combination of blanks.

15. The combination of blanks of claim 14, wherein the reinforcement blank comprises pulp fibers.

16. The combination of blanks of claim 15, wherein the reinforcement blank is for being molded when the container is formed from the combination of blanks.

17. The combination of blanks of claim 16, wherein the reinforcement member is for being molded so as to have a density within the range of from about 0.2 kg/dm$^3$ to about 1.5 kg/dm$^3$ when the container is formed from the combination of blanks.

18. The combination of blanks of claim 15, wherein the reinforcement blank comprises a central portion and a marginal portion for forming least one wall extending upwardly from the central portion along the lid flange when the container is formed from the combination of blanks.

19. The combination of blanks of claim 18, wherein the reinforcement blank is a first reinforcement blank for being at least partially received in the lid recess when the container is formed from the combination of blanks, wherein the bottom blank is for at least partially forming a bottom recess of the container formed from the combination of blanks between the bottom panel and a bottom flange extending away from the bottom panel when the container is formed from the combination of blanks, and the combination of blanks further comprises a second reinforcement blank for being at least partially received in the bottom recess when the container is formed from the combination of blanks.

20. The combination of blanks of claim 19, wherein the second reinforcement blank comprises pulp fibers.

21. The combination of blanks of claim 20, wherein the second reinforcement blank comprises a central portion and a marginal portion for forming at least one wall extending downwardly from the central portion along the bottom flange of the container when the container is formed from the combination of blanks.

22. The combination of blanks of claim 18, wherein the body blank comprises a lid forming portion for at least partially forming the lid flange when the container is formed from the combination of blanks, the lid forming portion of the body blank is at least partially separable from and at least foldably connected to the body forming portion of the body blank at a line of weakening.

23. The combination of blanks of claim 22, wherein the container further comprises at least one barrier blank for being attached to the body formed from the combination of blanks in the interior of the container formed from the combination of blanks.

24. The combination of blanks of claim 23, wherein the at least one barrier blank comprises a pull tab and at least one tear region at least partially separable from the remainder of the at least one barrier blank to facilitate access to the interior of the container formed from the combination of blanks.

25. A method of forming a container for holding at least one article, the method comprising:

obtaining a body blank comprising a body forming portion;

obtaining a lid blank comprising a central portion and a marginal portion;

obtaining a reinforcement blank;

obtaining a bottom blank;

positioning the body forming portion of the body blank to form a body extending at least partially around an interior of the container;

positioning the bottom blank to form a bottom panel and attaching the bottom panel to the body to form a closed bottom of the container;

positioning the central portion of the lid blank to form a lid panel and positioning the marginal portion of the lid blank to form a lid flange extending upwardly form the lid panel to form a lid of the container such that a lid recess is at least partially formed between the lid panel and the lid flange, and such that the lid repositionable between a closed position at least partially overlying the body and an open position at least partially raised away from the body; and positioning the reinforcement blank in the lid recess to form a reinforcement member of the container.

26. The method of claim 25, wherein the reinforcement blank comprises pulp fibers.

27. The method of claim 26, further comprising molding the reinforcement blank to form the reinforcement member.

28. The method of claim 26, wherein the reinforcement member is molded so as to have a density within the range of from about 0.2 kg/dm$^3$ to about 1.5 kg/dm$^3$.

29. The method of claim 26, wherein the reinforcement blank comprises a central portion and at least one marginal portion, and positioning the reinforcement blank to form a reinforcement member comprises positioning the marginal portion to form at least one wall extending upwardly from the central portion along the lid flange.

30. The method of claim 29, wherein the at least one wall of the reinforcement member comprises a first vertical wall and a second vertical wall, and the reinforcement member comprises an intermediate flange extending from the first vertical wall to the second vertical wall.

31. The method of claim 30, wherein an outer rim extends away from the second vertical wall to at least partially overlie a top edge of the lid.

32. The method of claim 29, wherein the reinforcement member is a first reinforcement member at least partially received in the lid recess, the method comprises at least partially forming a bottom recess of the container between the bottom panel and a bottom flange extending away from the bottom panel, and the method further comprises at least partially positioning a second reinforcement member in the bottom recess.

33. The method of claim 32, wherein the second reinforcement member comprises molded pulp fibers.

34. The method of claim 33, wherein the second reinforcement member comprises a central portion and at least one wall extending downwardly from the central portion along the bottom flange.

35. The method of claim 29, wherein the lid flange is at least partially separable from and at least foldably connected to the body at a line of weakening.

36. The method of claim 35, wherein the method further comprises attaching at least one barrier member to the body in the interior of the container.

37. The method of claim 36, wherein the at least one barrier member comprises a pull tab and at least one tear region at least partially separable from the remainder of the at least one barrier member to facilitate access to the interior of the container.

* * * * *